US006052658A

United States Patent [19]

Wang et al.

[11] Patent Number: 6,052,658

[45] Date of Patent: Apr. 18, 2000

[54] METHOD OF AMPLITUDE CODING FOR LOW BIT RATE SINUSOIDAL TRANSFORM VOCODER

[75] Inventors: De-Yu Wang; Wen-Whei Chang, both of Taoyuan; Hwai-Tsu Chang, Hsinchu; Huang-Lin Yang, Taipei, all of Taiwan

[73] Assignee: Industrial Technology Research Institute, Hsinchu Hsien, Taiwan

[21] Appl. No.: 09/094,448

[22] Filed: Jun. 10, 1998

[30] Foreign Application Priority Data

Dec. 31, 1997 [TW] Taiwan ..... 86120025

[51] Int. Cl.[7] ..... G10L 19/02

[52] U.S. Cl. ..... 704/205; 704/208; 704/212; 704/230

[58] Field of Search ..... 704/203, 205, 704/206, 207, 208, 212, 230

[56] References Cited

U.S. PATENT DOCUMENTS

| | | | |
|---|---|---|---|
| 5,537,647 | 7/1996 | Hermansky et al. | 704/211 |
| 5,588,089 | 12/1996 | Beerends et al. | 704/205 |
| 5,625,743 | 4/1997 | Fiocca | 704/205 |
| 5,864,794 | 1/1999 | Tasaki | 704/214 |

OTHER PUBLICATIONS

Wang et al., "An Objective Measure for Predicting Subjective Quality of Speech Coders", IEEE Journal on Selected Areas in Communications, vol. 10, No. 5, pp. 819 to 829, Jun. 1992.

"DPCM Coding of Spectral Amplitudes Without Positive Slope Overload", Michael J. Sabin, *IEEE Transactions on Signal Processing*, vol. 39, No. 3, Mar. 1991, pp. 756–758.

"Sine–Wave Amplitude Coding at Low Data Rates", McAulay et al., pp. 203–213.

"Low–Rate Speech Coding Based on the Sinusoidal Model", McAulay et al., pp. 165–208.

*Primary Examiner*—David R. Hudspeth
*Assistant Examiner*—Martin Lerner
*Attorney, Agent, or Firm*—McDermott, Will & Emery

[57] ABSTRACT

The present invention provides a sinusoidal transform vocoder based on the Bark spectrum, which has high quality and low bit rate for coding. The present invention includes the steps of transforming a harmonic sine wave from a frequency spectrum to a perception-based Bark spectrum. An equal-loudness pre-emphasis and the loudness to a subjective loudness transformation are also involved in the method. Last, a pulse code modulation (PCM) is used to quantize the subjective loudness to obtain quantized subjective loudness. In synthesis, the Bark spectrum is inversely processed to obtain the excitation pattern following the sone-to-phone conversion and equal-loudness deemphasis. Then, the sine wave amplitudes can be estimated from the excitation pattern by assuming that the amplitudes belonging to the same critical band are equal.

8 Claims, 5 Drawing Sheets

METHOD OF AMPLITUDE CODING FOR LOW BIT RATE SINUSOIDAL TRANSFORM VOCODER

FIELD OF THE INVENTION

The present invention relates to a coding method, and more particularly, to an improved method of amplitude coding for low bit rate sinusoidal transform vocoder.

BACKGROUND OF THE INVENTION

The research of the low bit rate coding is primarily applied in the field of commercial satellite communication and secure military communication. Recently, three major vocal coding standards, FS1015 LPC-10e, INMARSAT-M MBE, FS1016 CELP, are set at 2400, 4150 and 4800 bps bit rates, respectively.

Sinusoidal Transform Coder (STC) is proposed by Quatieri and McAulay who are researchers in MIT. The wave form of speech exhibits the characteristic of periodicity and the speech spectrum has a high peak density, thus the STC uses the multi sine-wave excitation filters to synthesize speech signal and compares the signals to the initial input signal to determine the frequency, amplitude and phase of each individual sine-waves. Further details can be found in an article proposed by T. F. Quatieri, R. J. McAulay, "Speech Transforms Based on Sinusoidal Representation", IEEE, Trans. on Acoust, and Signal Process, 1986.

The requirement of the vocoder with low bit rate can not be achieved by directly quantizing the parameters according to the sine waves. The frequencies of the sine waves are regarded as the composition of a plurality of certain individual harmonic frequencies. To maintain the phase continuation between the frames, the phase parameters obtain the vocal trace filter phase response by the postulation of the minimum phase and synchronize the onset time of the excitation. Further, the sine wave amplitude is simulated using cepstral or all-pole model to achieve the purpose of simplifying the parameters. The method could simplify the parameter bits and effectively synthesize the signal to get the initial vocal signal. Therefore, it can achieve the requirement of coding with 2.4 Kbps low bit rate.

The sine wave amplitude coding is represented by the following formula (1):

$$s(n) = \sum_{s=1}^{L} A_s \cos(\omega_s n + \varphi_s) \tag{1}$$

wherein $A_s$ denotes the amplitude, $\omega_s$ represents the frequency and $\phi_s$ represents the phase.

The basic sine wave analysis-by-synthesis framework will be described as follows. The analysis of the STC is based on the speech production model as shown in FIG. 1. Further details can be found in L. Raniner, "Digital Processing of Speech", Prentice-Hall, Englewood, Cliffs, N.J., 1978. In FIG. 1, The oscillation of the excitation can be presented by $$e(t) = \sum_{k} A_k \exp\{j[\omega_k(t - t_0)]\}.$$

Let $Hg(\omega)$ and $H_v(\omega)$ indicate the glottis and vocal tract responses respectively. Therefore, the system function $H_s(\omega)$ is indicated by the function (2):

$$H_s(\omega)=H_g(\omega)H_v(\omega)=A_s(\omega)exp[j\phi_s(\omega)] \tag{2}$$

Consequently, each vocal wave form of the analysis frame can be denoted by $$s(n) = \Sigma_{s=1}^{L} A_s \cos(\omega_s n + \varphi_s).$$

The vocal signal can be decomposed into a plurality of sine waves. Accordingly, the frequencies, phases, and amplitudes of the sine waves can also be composed to approximately form the initial vocal signal.

Turning to FIG. 2, it shows the sinusoidal analysis-synthesis module. First, the speech is input to a Hamming window 200 to obtain the frame for analysis. Then, the frame is transformed from time domain to frequency domain by discrete Fourier transform (DFT) 210. This has a benefit for short-time frequency analysis. Next, frequencies and amplitudes are found at peaks of the speech amplitude response by a peak picking method according to the absolute value of DFT output. Phase are then obtained by taking arc tangent ($\tan^{-1}$) 220 of the output of DFT 210 at all peaks. In the model of synthesis, the phase and frequency are operated by frame-to-frame unwrapping, interpolation and frame-to-frame frequency peaks birth-death matching and interpolation 250 to obtain the phase $\theta(n)$ of the frame. The amplitude is fed and frame-to-frame linear interpolation 255 is used to maintain continuity between the neighboring frames and obtaining the amplitude $A(n)$. Then, the phase $\theta(n)$ and the amplitude $A(n)$ are fed to sine wave generator 260, then sum all the sine wave 280, thereby composing the sine wave (synthesis speech output) consisting of each individual frame.

However, it can not meet the demand of the low bit rate coding by means of directly analyzing the amplitude, phase and frequency of each sine wave. Therefore, what is required is a model associated with phase, amplitude and frequency and the model uses less parameters for coding.

The description according to the model for the sine wave phase can be seen below. The STC constructs a sine wave phase model in order to reduce the coding bit for phase. The phase is divided into an excitation phase and a glottis, vocal tract phase response. Further, the phase residual of the voicing dependent model is adjusted in accordance with the voicing probability.

The excitation phase can be obtained via the onset time of excitation that can be estimated by vocal pitch. The phases of glottis and vocal tract can be calculated using the cepstral parameters by the posotulation of minimum phase. Thus, only the voicing probability (Pv) is needed to be coded and must be known to obtain phase residual. The voicing probability (Pv) occupies about 3 bits.

In the model for the sine wave frequency, all of the sine wave frequencies are regarded as a harmonic wave having fundamental frequency $\omega_0$, the sine wave can be represented as follow.

$$s(n) = \sum_{s=1}^{L} A_s \cos(\omega_0 ns + \varphi_s)$$

Thus, all of the frequencies of the sine wave can be obtain by coding only one pitch. The pitch occupies about 7 bits.

If the vocal signal is directly synthesized using fundamental frequency and harmonic wave, then the synthesized signal is sound disharmonic. One of the prior art relating to the issue is an article proposed by R. J. McAulay, T. F. Quatieri, "Pitch Estimation and Voicing Detection Based on a Sinusoidal Model", Proc. of IEEE Intrl. Conf. on Acoust., Speech, and Signal Processing, Albuquerque, pp. 249–252, 1990. The method can be seen briefly as follows.

step 1. defining the cut off frequency ($\omega_c$) in accordance with the voicing probability ($P_v$). $\omega_c(P_v)=\pi P_v$ step 2. defining the maximum sampling interval ($\omega_u$) of the noise, the $\omega_u$ is about 100 Hz.

step 3. sampling

A. If the $\omega_0$ is lower than $\omega_u$, then the entire frequency spectrum is sampled as $\omega_0$.

B. otherwise, the voicing that lower than $\omega_c$ is sampled $\omega_0$. the noise that higher than $\omega_c$ is sampled as $\omega_u$.

$$\omega_k = \begin{cases} k\omega_0 & k\omega_0 \leqq \omega_c(P_v) \\ k^*\omega_0 + (k-k^*)\omega_u & k\omega_0 > \omega_c(P_v) \end{cases} \quad (3)$$

wherein k* is the maximum integer under the condition $k^*\omega_0 \leqq \omega_c(P_v)$.

There are variety methods to overcome an issue relating to that the number of the sine ravage in each frame is not a constant number. A prior art uses a coding method relating to the cepstral representation to solve the problem. This can refer to the paper disclosed by J. McAulay, T. F. Quatieri. "Sinwave Amplitude Coding Using High-order Allpole Models", Proc. of EURSIP-94, pp. 395–398, 1991. Another method used the all-pole model for coding, which exhibits a certain number of amplitude in each frame. Please see the article proposed by T. F. Quatieri, R. J. McAulay, "Speech Transform Based on a Sinusoidal Representation", IEEE Trans. on Acoust., Speech, and Signal Process, ASSP-314:1449–1464, 1986 and a further article proposed by A. M. Kondoz, "INMARSAT-M:Quantization of Transform Components for Speech Coding at 1200 bps", IEEE Publication CD-ROM. 1991). Lupini used a vector quantization of harmonic magnitudes for speech coding. For example, P. Lupini, V. Cuperman, "Vector Quantization of Harmonic Magnitudes for Low-rates Speech Coders", Proc. of IEEE Globecom, San Francisco, pp. 165–208, 1992.

McAulay proposed that the cepstral should be used to represent the amplitude parameters in the sine wave transform coder. It exhibits the potential to develop the minimum phase model. It does not involve the calculation of the phase response of filters.

FIG. 3 is a scheme showing the 2.4 Kbps STC vocoder in accordance with McAulay. The speech is analyzed by Hamming window 300 to obtain the analyzed speech frame. After the speech frame is transformed via fast fourier transform (FFT) 310, the speech frame is estimated by pitch estimate 320 and pre-process 330 (spectrum envelope estimation vocoder; SEEVOC) to obtain the sine wave amplitude envelope. The SEEVOC can achieve the sine wave amplitude envelope. Then, the signal is calculated by using the tools relating to the cepstral coefficient 340 and cosine transformation thereby obtain a group of channel gains that represents the amplitude. Next, the channel gains are fed to DPCM 360 for quantization. Then, the quantified channel gains are quantized by means of scalar quantization in accordance with the voicing probability 365 and the pitch estimation.

In synthesis, the quantized channel gains are processed by inverse DPCM 360*a*, cosine transformation 350*a*, for achieving the cepstral parameters. Subsequently, the cepstral parameters are transformed by inverse cepstral 340*a* from cepstral parameters to spectrum envelope 330*a*. The harmonic wave amplitude 320*a* can be achieved by synthesizing the spectrum envelope 330*a* and the harmonic wave frequency of the pitch. The phase 315*a* for the synthesized signal is generated by three major portions. First, the phase component of glottis and vocal tract system is obtained by cepstral. Further, the phase component of the excitation can be obtained from pitch. The third, the phase residual is calculated from the voicing probability. The obtained amplitude, phase, frequency have to match with the frame-to-frame matching 310*a* that includes the birth-death matching, linear interpolation for synthesizing the speech, thereby keeping the continuation of signals between the neighboring speech frames. Finally, the synthesized speech is output after the step of synthesis 305*a*.

Turning to FIG. 4, it shows the method of amplitude coding of McAulay in accordance with FIG. 3. The speech signals of each the speech frame are initially transformed to short time spectrum domain by means of FFT 310. Then, speech signal is performed by SEEVOC 330 to obtain the sine wave amplitude envelope. Next, the linear interpolation 400, spectral warping 410and low pass filter 420, cepstral 340 are respectively used to get the cepstral parameters for achieving the purpose of low bit rate quantization.

Subsequently, the cepstral parameters are transformed by using cosine transformation to obtain the channel gains. Next step is quantization. In order to achieve this purpose, DPCM or vector quantization can be used. The quality of the synthesized signal is not bad by using the aforesaid method. However, the tone is sound not only low but also heavy. MsAulay added a post filter adjacent to the receiver to solve this problem. The decoding method involves the inverse procedures of the aforementioned steps. Apparently, inverse DPCM 360*a*, cosine transform 350*a*, inverse cepstral 340*a*, post filter 420*a* are used to get the cepstral parameters. Then, post filter 420*a* is introduced to eliminate the problem related to the tone is sound too low and heavy. The processed signal is subsequently fed to inverse spectral warping 410*a*, and harmonic sampling 405. Finally, the synthesized speech is output after synthesis.

The major portion of the quantization bits are used for amplitude quantization. Therefore, the quality of the synthesized speech is primarily depending on the fidelity of the amplitude quantization. Although the conventional sine wave coding has been improved by McAulay by using frequency warping. However, the issue associated with the sound pressure level is still under developed.

SUMMARY OF THE INVENTION

The current coding method does not involve the psychoacoustic effect, therefore, the object of the present invention is to provide a sine wave coding method by using psychoacoustic effect.

The another object of the present invention utilize the Bark spectrum company with frequency, phase quantization to code or decode a speech signal with 2.4 Kbps low bit rate.

The coding method includes modeling amplitudes of a speech spectrum by using harmonic wave modeling to obtain a speech waveform, and transferring the speech waveform from a frequency spectrum to a Bark spectrum to obtain Bark parameters using a Bark-to-Hz transformation. Then, the Bark parameters and integrated to obtain a frequency response of an excitation pattern using critical-band integration. The frequency response is transferred to a loudness by using equal-loudness pre-emphasis; and the loudness is transferred to a subjective loudness.

The present invention provides a method for synthesis using the Bark spectrum. The synthesis method based on a Bark spectrum includes transferring channel gains to a subjective loudness using an inverse pulse code modulation; transferring the subjective loudness to a loudness; transferring the loudness to obtain an excitation pattern using an equal de-emphasis; transferring the Bark spectrum to a frequency spectrum; and achieving harmonic wave frequencies and amplitudes by using pitch and voicing probability. First, the Bark spectrum is transferred to phon unit using the sone-to-phon transform. Then, the inverse operations, such as de-emphasis et al. are used to obtain the band energy D(b). Subsequently, the pitch and voicing probability are introduced to obtain the frequency. Then, the amplitude is also obtained. Assume that the input signal energy for coding $|X(f)|^2$ is equal to $|X(Y(b))|^2$. The output of the critical band filter D(b) is equal to $F(b)*|X(Y(b))|^2$. For decoding, each harmonic wave amplitude is achieve by using the excitation model. Fist step is to define the harmonic wave location. $X_i$ is indicated the i-th harmonic wave energy, others are set to zero. Assume that there is no overlap between the filters.

$$D(i)=f_{i,j_1}X_{i1}+f_{i,j_2}X_{i2}+\ldots+f_{i,j_m}X_{im}+\ldots+f_{i,j_M}X_{iM}\quad 1\leq i\leq B.$$

Wherein $f_{i,jm}$ is the filter coefficient of the m-th harmonic wave $X_{im}$ in accordance with the i-th filter. M indicates harmonic wave number in the i-th filter. When, M is less or equal to 1, the function has only one solution. Otherwise, there is no solution. Thus, the second postulation is made as follows:

Postulation 2: the energy of each harmonic wave in the same filter is equal.

Assume that $\overline{X}=X_{i1}=X_{i2}=\ldots=X_{iM}$, then $$D(i)=f_{i,j_1}X_{i1}+f_{i,j_2}X_{i2}+\ldots+f_{i,j_M}X_{iM}$$
$$=(f_{i,j_1}+f_{i,j_2}+\ldots+f_{i,j_M})\cdot\overline{X}=f_i\cdot\overline{X},\ 1\leq i\leq B$$

The use of the functions can solve all the coefficients $f_{i,j_M}$ of the filters. Thus, the synthesis method based on the Bark spectrum is completed, and the present invention can provide many benefits over the prior art.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

The present invention uses the Bark spectrum instead of the spectrum estimation of the sine wave transform coding (STC). The novel method includes the HZ-to-Bark transformation, critical-band integration, equal-loudness pre-emphasis and subjective loudness. It is hard to introduce Bark spectrum to the STC due to the band of Bark spectrum is not enough for coding, actually, there are only 14 Barks from 0 to 4K Hz. It is unlikely to increase the band of the Bark spectrum since it is limited by the warping function. In order to improve the acoustic effect, the present invention provides a Bark spectrum model instead of the STC cepstral model to improve the acoustic effect. Further, the method uses the pulse code modulation (PCM) to quantize the Bark spectrum parameters for achieving high efficiency amplitude coding. In the decoding, the present invention provides a synthesis method based on the Bark spectrum. The present invention can be seen as follows.

Figure 1:
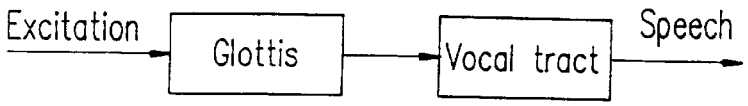
FIG.1 (Prior Art)
FIG. 1 is a scheme showing the glottis and vocal tract system according to the prior art.
Figure 2:
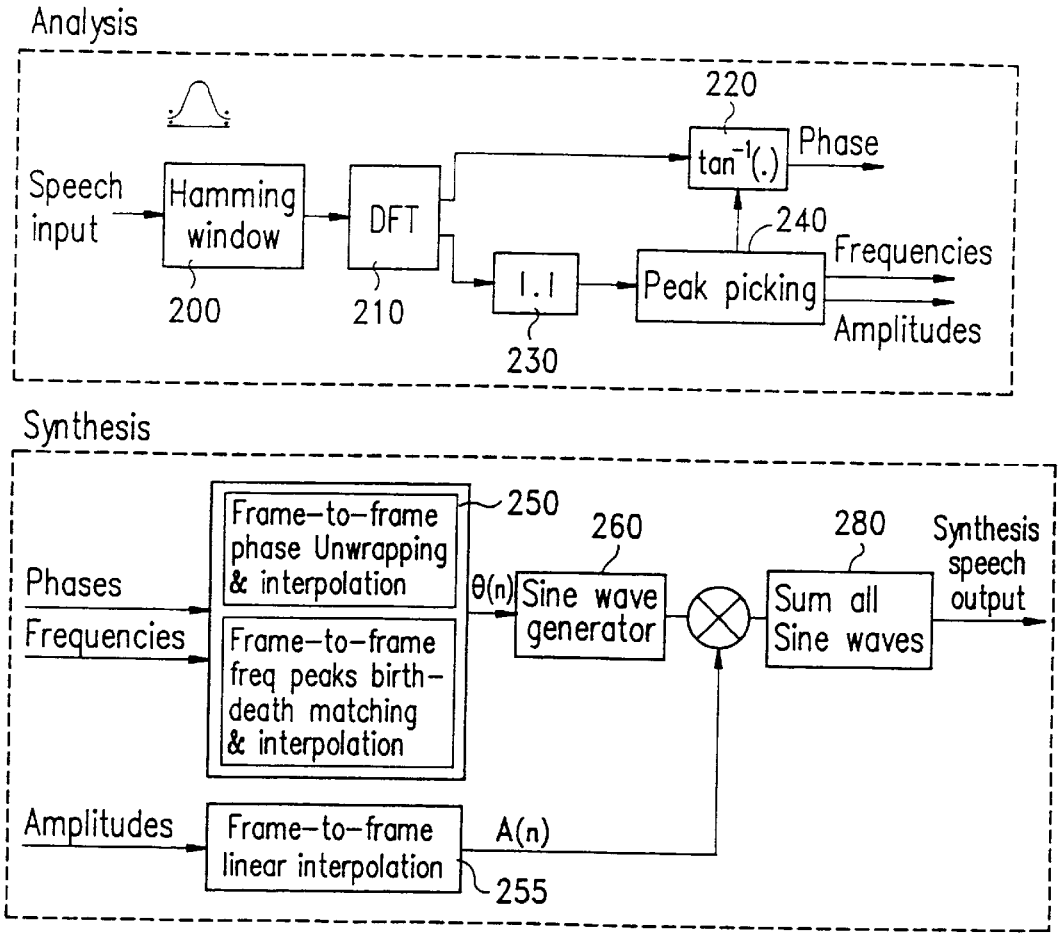
FIG.2 (Prior Art)
FIG. 2 is a sine wave analysis and synthesis model in accordance with the prior art.
Figure 3:
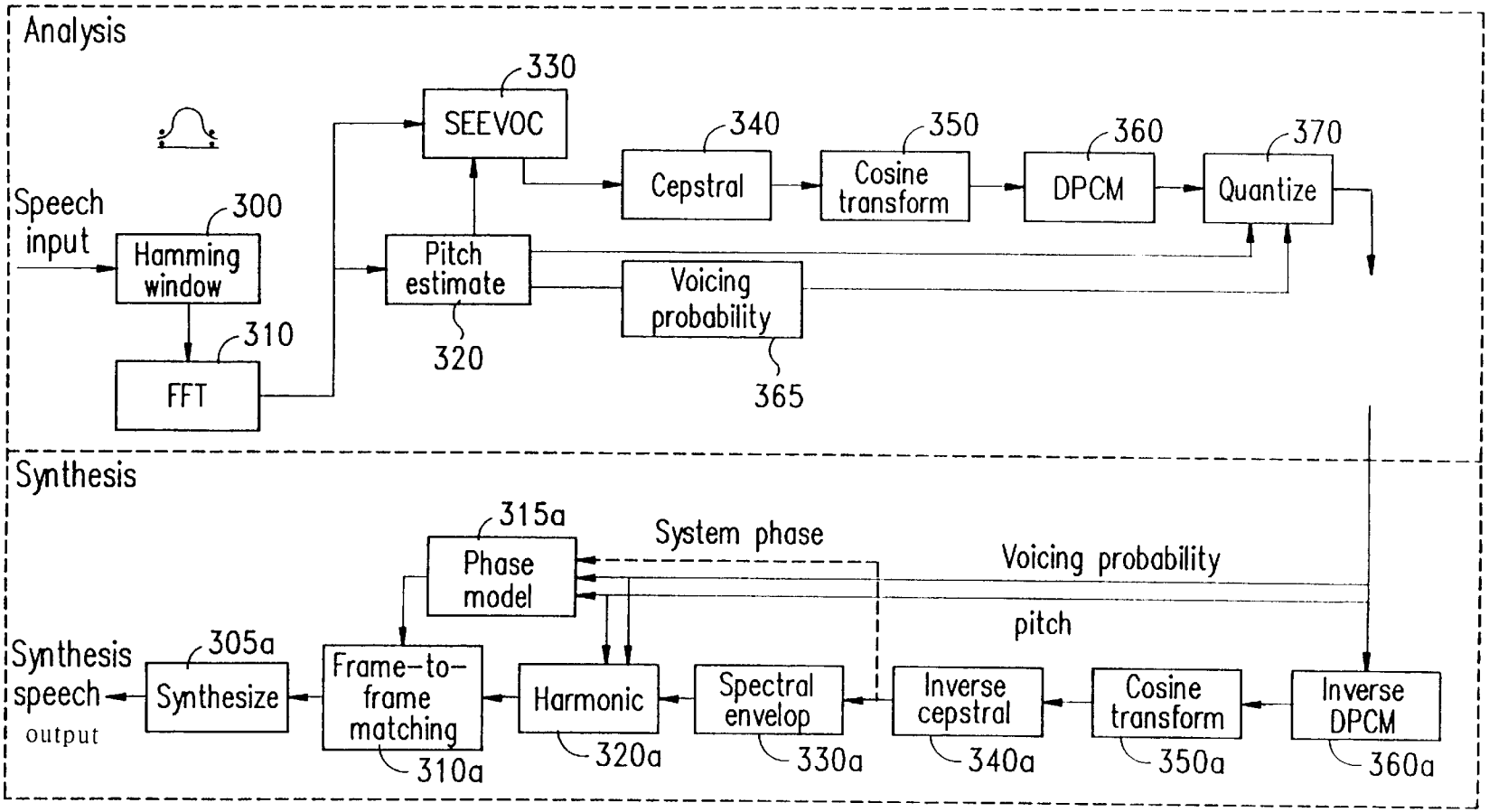
FIG.3 (Prior Art)
FIG. 3 is a scheme showing the 2.4 Kbps STC vocoder in accordance with McAulay.
Figure 4:
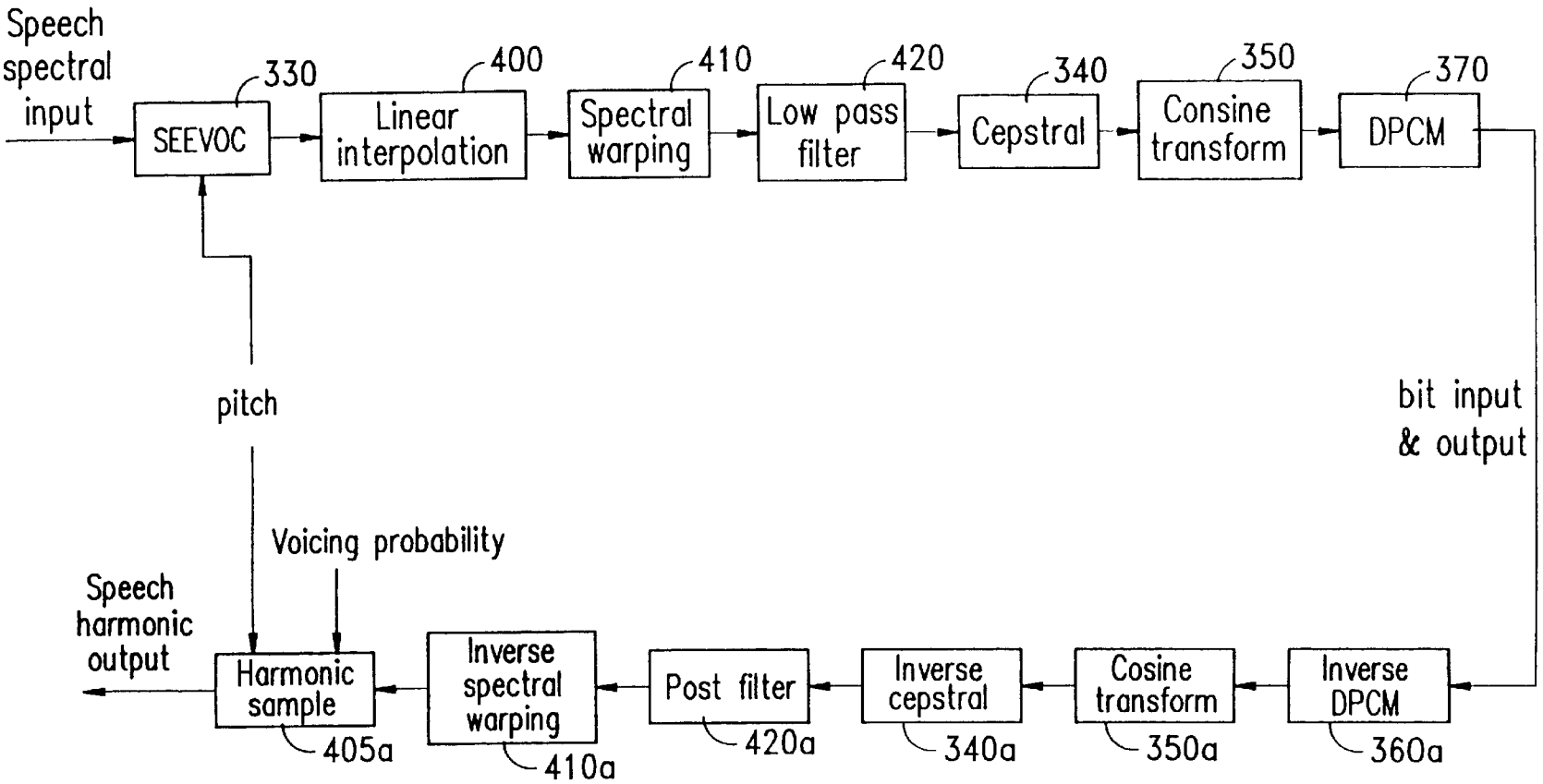
FIG. 4 (Prior Art)
FIG. 4 is a scheme showing the method of amplitude coding of McAulay in accordance with FIG. 3.
Figure 5:
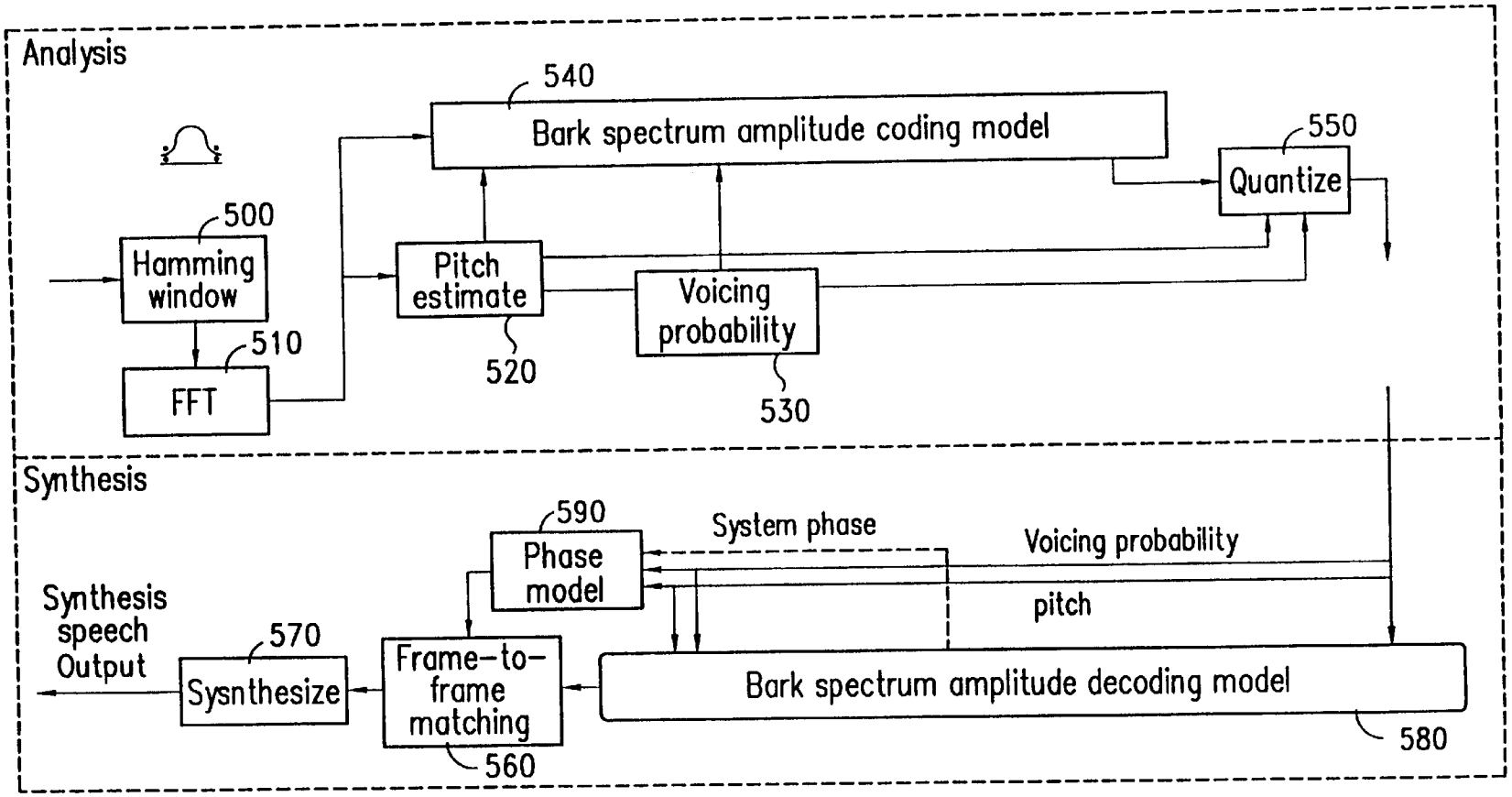
FIG. 5 is a scheme showing the 2.4 Kbps STC vocoder in accordance with the present invention.

Turning to FIG. 5, it is a schematic drawing to show the 2.4 Kbps STC vocoder in accordance with the present invention. A speech is fed into Hamming window 500 to obtain the speech frame for analysis. Each speech frame is estimated by using pitch estimation 520 after the speech frame transformed by fast fourier transform (FFT) 510. Thus, the step can obtain the information about not only the pitch, but also the onset time that can be used to determine the voicing probability. The speech frame transformed by FFT 510 is also transferred to subjective loudness by using the Bark spectrum amplitude coding model 540. Then, the subjective loudnesses are quantized by using the pulse code modulation (PCM) 550.

In the synthesis, the parameters after the initial decoding include quantized subjective loudnesses, pitch and voicing probability. The subjective loudnesses are transferred by Bark spectrum amplitude decoding model 580 to harmonic sine-wave amplitudes. Then, the sine wave amplitudes for the synthesis speech signal can be obtained by the Bark spectrum harmonic sampling according to harmonic frequency of the speech fundamental frequency. The phase for the synthesized speech signal is constructed by three portions (phase model 590). The first one is phase component of the glottis and vocal tract system that can be obtained by means of Bark spectrum model. The second one is phase component of excitation that can be obtained by the pitch. The last one is phase residual value that can be calculated from the voicing probability. The frequency, phase and amplitude achieved by aforesaid procedure have to be accompanied by frame-to-frame matching 560, birth-death matching and linear interpolation to synthesize the speech 570 such that the synthesized speech shows continuity between the frames.

Figure 6:
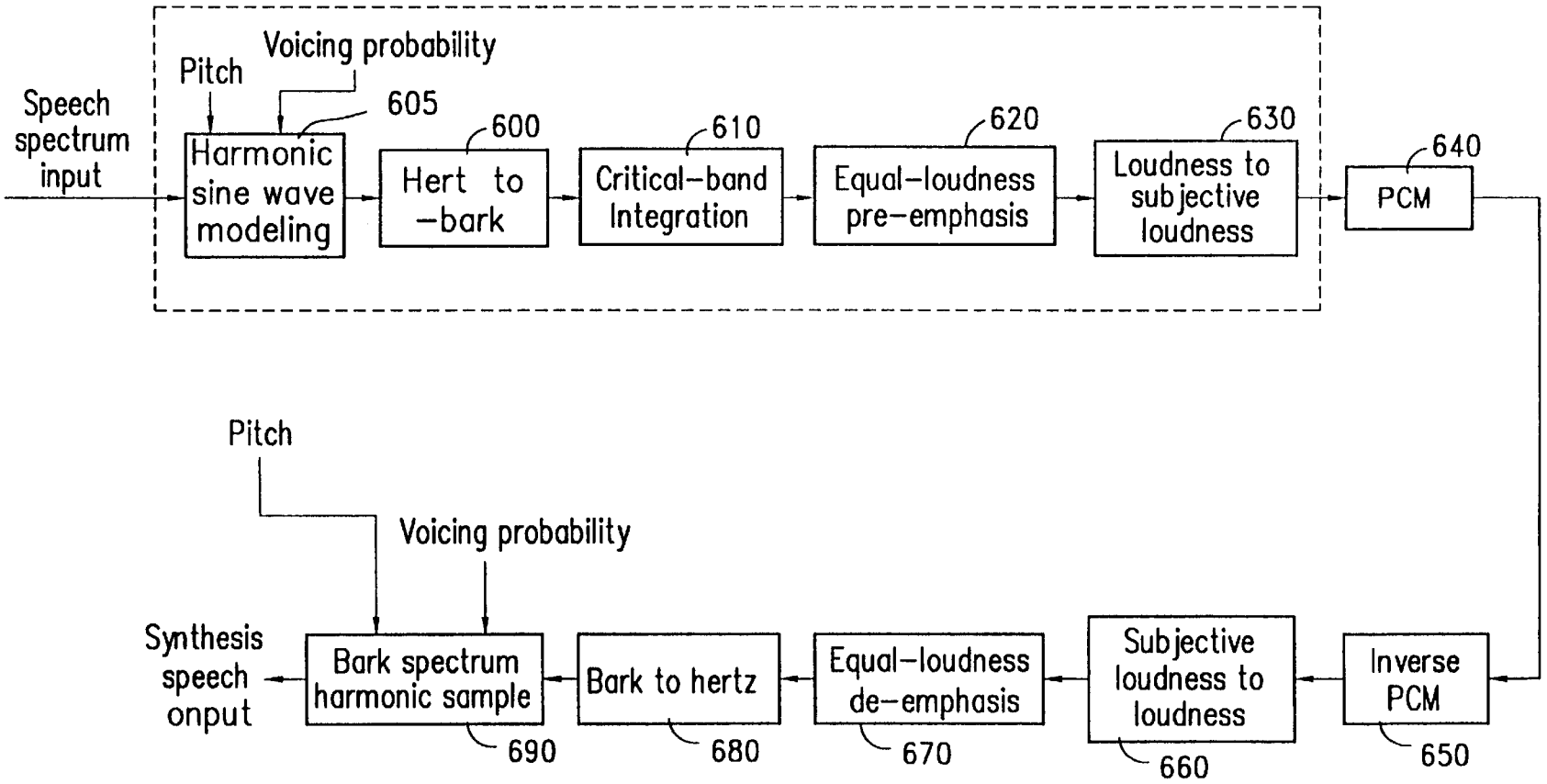
FIG. 6 is a scheme showing the method of amplitude coding of Bark spectrum in accordance with the present invention.

FIG. 6 is a scheme showing the method of amplitude coding of Bark spectrum in accordance with the present invention. The speech spectrum are modeling by using harmonic sine wave model with pitch and voicing probability inputs. The speech frame after the transformation of FFT is then transformed between Hz and Bark 600. Prior to the Hertz to Bark transformation, amplitudes of a speech spectrum are modeled (step 605) according to pitch and voicing probability by using a harmonic wave modeling to obtain a speech waveform. Then, the speech waveform is transferred from a frequency spectrum to a Bark spectrum to obtain Bark parameters using a Bark-to-Hz transformation.

In the model, the audition can be regarded as a series of filters. The centrals of the spectrums of each filters are located at integral Bark (1, 2 . . . , 14 Bark), thus the band width is exactly 1 Bark. However, the sensitivities of the filters to a same signal are different. Further, the sensitivities of the filters to signal under different loudnesses are also different. Then, the obtained Bark parameters are the signal energy received by each filters. Therefore, the obtained parameters must undergo by HZ-to-Bark transformation, critical-band integration, equal-loudness preemphasis and phone-to-sone subjective loudness.

The human audition is insensitive to high frequency signal. Therefore, the frequency of the speech signal has to be wrapped, first. The Hz-to-Bark transformation has a similar purpose to that of frequency wrapping according to prior art. The Bark (b) to frequency (f) relationship is shown in function (4). Wherein the Y(b) indicates the critical-band density. The frequency (f) to Bark (b) is shown in function (5).

$$Y(b)=f=600 \sin h[(b+0.5)/6] \text{ Hz} \tag{4}$$

$$b=Y^{-1}(f)=6 \ln\{(f/600)+[(f/600)^2+1]^{1/2}\}-0.5 \text{ Bark} \tag{5}$$

Subsequently, the speech frame in the Bark frame is performed by critical-band integration 610 for frequency response of the frequency-band energy. In order to achieve the band energy of the filters, the band filters with 1 Bark frequency width are used (Please refer to S. Wang, et al., "An Objective Measure for Predicting Subjective Quality of Speech Coders", IEEE J. Select Areas Commun, pp. 819–829, 1992):

$$10 \log_{10} F(b)=7-7.5(b-0.215)-17.5[0.196+(b-0.215)^2]^{1/2} \tag{6}$$

Apparently, the frequency is higher, the frequency width of the filter is wider, this can be seen from the frequency response of the critical-band filters. The input signal energy $|X(Y(b))|^2$ and F(b) are operated by convolution, then the excitation pattern D(b):

$$D(b) = F(b) * |X(Y(b))|^2 = \sum_k F(k-b)|X(Y(k))|^2$$

The intensity unit of the signal will be transformed from dB to loudness unit (phon), the spectrum after the transformation is loudness equalized. Wherein the phon is defined by the loudness level dB in accordance with 1 KHz. Successively, a step of equal-loudness preemphasis 620 is used to process the signal operated by convolution to achieve the loudness P(b). In the preferred embodiment, the preemphasis filter having the frequency response $H(z)=(2.6+z^{-1})/(1.6+z^{-1})$ can be used to transfer the speech signal from dB to phon, $P(b)=H(f)|_{f=Y(b)}*D(b)$.

After the loudness is obtained, the last step is to obtain the non linear response of the audition according to the variation of the loudness. For example, the loudness increases from 40 phon to 50 phon, the extra 10 phons will double the loudness. But if the loudness increases from mininum audible field (MAF) to 10 phon, the 10 phons will increase the loudness by a fact of ten. Thus, the final step in Bark spectrum model is to transfer the loudness unit from the phon unit to subjective loudness 630. The unit of the subjective loudness 630 is sone (L). The transformation between the phon (P) and sone (L) are shown as follows.

$$L = \begin{cases} 2^{(P-40)/10} & \text{if } P \geq 40 \\ (P/40)^{2.642} & \text{if } P < 40 \end{cases} \tag{7}$$

After the signal is transferred to subjective loudness, then a quantization step is carried out to quantize the signal. For example, PCM quantization can be applied in this step.

During the synthesis or decoding procedure, the quantized signal is performed by an inverse PCM step 650 to transferred the quantized signal to subjective loudness. Subsequently the subjective loudness is transferred to loudness by means of a subjective loudness to loudness transformation 660. The next is the use of the equal-loudness de-emphasis 670 to transfer the loudness to the excitation pattern. The Bark-to-Hz 680 is used to transform the energy to a frequency spectrum.

The synthesis of the Bark spectrum provides an amplitude coding with an improved auditive effect. However, the Barks parameters can not be directly employed to synthesize a speech signal. Thus, one of the features of the present invention is the transference of the Bark parameters to a harmonic wave amplitude.

First, the excitation pattern D(b) is obtained from the Bark spectrum by the transformations of the sone-to-phon and de-emphasis. Next, the pitch and the voicing probability are introduced to obtain the frequency, amplitude of the harmonic wave. The aforesaid step is called Bark spectrum harmonic sampling 690 in FIG. 6. If the signal energy is $|X(f)|^2=|X(Y(b))|^2$ in the coding, the output of the critical-band filter is $D(b)=F(b)*|X(Y(b))|^2$. The term can be transferred into a matrix form as follows.

$$\begin{bmatrix} f_{1,0} & f_{1,1} & \cdots & f_{1,N/2-1} \\ f_{2,0} & f_{2,1} & \cdots & f_{2,N/2-1} \\ \vdots & \vdots & \ddots & \vdots \\ f_{B,0} & f_{B,1} & \cdots & f_{B,N/2-1} \end{bmatrix} \begin{bmatrix} |X(0)|^2 \\ |X(1)|^2 \\ \vdots \\ |X(N/2-1)|^2 \end{bmatrix} = \begin{bmatrix} D(1) \\ D(2) \\ \vdots \\ D(B) \end{bmatrix} \tag{8}$$

wherein $f_{i,j}=F(Y^{-1}(j*f_s/N)-i)$, $f_s$ is the sampling frequency, N is the length of FFT, B represents the number of the filters.

In the decoding, harmonic wave amplitude |X(i)| can be achieved by using the excitation pattern D(b). First, the location of the harmonic wave can be defined by using the conventional method and $X_i$ represents the energy of the i-th harmonic wave, while that of the others is set to zero. Thus, the matrix (8) can be altered to:

$$\begin{bmatrix} f_{1,0} & f_{1,1} & \cdots & f_{1,N/2-1} \\ f_{2,0} & f_{2,1} & \cdots & f_{2,N/2-1} \\ \vdots & \vdots & \ddots & \vdots \\ f_{B,0} & f_{B,1} & \cdots & f_{B,N/2-1} \end{bmatrix} \begin{bmatrix} \vdots \\ X_1 \\ \vdots \\ X_p \\ \vdots \end{bmatrix} = \begin{bmatrix} D(1) \\ D(2) \\ \vdots \\ D(B) \end{bmatrix} \tag{9}$$

wherein P is the harmonic wave number according to the variation of the fundamental frequency. When B≧P. the matrix (9) has only one solution. On the contrary, when B<P, there is more than one solution to the matrix (9). Thus, in order to solve the matrix (9), two postulations are needed:

Postulation 1: the filters do not overlap each other. Thus, the matrix (9) is altered to $$\begin{bmatrix} f_{1,0} \cdots f_{1,b_1} & 0 & \cdots & 0 \\ & & & \vdots \\ 0 \cdots 0 & f_{2,b+1} \cdots f_{2,b_2} & & 0 \\ \vdots & & \ddots & \\ 0 & \cdots & 0 & f_{B,b_{B-1}+1} \cdots f_{B,b_B} \end{bmatrix} \begin{bmatrix} \vdots \\ X_1 \\ \vdots \\ X_p \\ \vdots \end{bmatrix} = \tag{10}$$

-continued $$\begin{bmatrix} D(1) \\ D(2) \\ \vdots \\ D(B) \end{bmatrix}$$

wherein $b_i$=Y(i+0.5)*N/$f_s$. Further, since there is no overlap between the filters, therefore, the matrix (10) can also be changed as following:

$$D(i)=f_{i,\ j_1}X_{i1}+f_{i,\ j_2}X_{i2}+\ldots+f_{i,\ j_m}X_{im}+\ldots+f_{i,\ j_M}X_{iM}\quad 1\leqq i\leqq B \tag{11}$$

wherein $f_{i,jm}$ represents the filter coefficient of the m-th harmonic wave $X_{im}$ in accordance with the i-th filter. M is the harmonic wave number in i-th filter. When, M is less than or equal to 1, the function (11) has only one solution. Otherwise, there is no solution. Thus, the second postulation is made as follows:

Postulation 2: the energy of every harmonic wave in the same filter is equal.

Assume that $\overline{X}=X_{i1}=X_{i2}=\ldots=X_{iM}$, then $$\begin{aligned} D(i) &= f_{i,j_1}X_{i1}+f_{i,j_2}X_{i2}+\ldots+f_{i,j_M}X_{iM} \\ &= (f_{i,j_1}+f_{i,j_2}+\ldots+f_{i,j_M})\cdot\overline{X}=f_i\cdot\overline{X},\ 1\leq i\leq B \end{aligned} \tag{12}$$

The use of the function (9) to (12) can solve all the coefficients $f_{i,\ j_M}$ of the filters. Thus, the synthesis method based on the Bark spectrum is completed.

TABLE 1 lists the STC according to the present invention. STC-B is referred to the STC vocoder which employs the the amplitude coding based on the Barked spectrum.

TABLE 1

| Coding Algorithm | STC-B |
|---|---|
| Original and synthesized speech specification | 16 bits linear PCM, 8 KHz sampling rate, band width 50 Hz–4 KHz |
| Compressed bit rate | 2400 bits each second compression rate: 53.33 |
| Frame size | 22.5 ms |
| The distribution of each frame | |
| Pitch | 7 bits |
| Voicing Probability | 3 bits |
| Maximum subjective loudness | 5 bits |
| 1st~14th subjective loudness | 39 bits |

The simulation results according to the present invention will be seen as follows. It is an important task to examine the vocoder quality. It is not limited to the subjective test for judging the quality of the vocoder. The objective test for distortion provides a reliable testing to the vocoder. The typical methods to examine the vocoder quality are, for example, the signal-to-noise ratio (SNR), and the segmental SNR. They compare the waveform difference between the original speech waveform and that of the coding waveform. However, such methods are unlikely to be effective when the bit rate is lower than 8000 bps. In 1992, Wang proposed a testing method called Bark spectrum distortion (BSD) to solve the problem. The frequency warping, critical-band integration, amplitude sensitivity variation with frequency and subjective loudness are introduced to Euclidean Distance. In addition, Watanabe respectively used the filter according to Wang and Hermansky to obtain the Bark spectrum in 1995 and he also employed the forward masking effect, which is called Bark spectrum distance rating (BSDR). They are more reliable for low bit rate vocoder test. Thus, the present invention uses the BSD and BSDR for testing and comparing to LPC-10e.

The STC-B, STC-C are respectively present the STC vocoder using amplitude coding based on the Bark spectrum, and cepstrum. The sampling of the speech signal is 8K Hz. The length of the speech frame according to STC-C is defined to contain 200 samples. Further, The length of the speech frame according to STC-B, LPC-10e both are defined to have 180 samples. The bit allocation of STC is shown in TABLE 1. Two males and two females, providing a total of four speech signals, are used for the test. The vocoders according to BSD/BSDR are shown in TABLE 2. TABLE 2 demonstrates that the STC-B is preferred to the STC-C for use in amplitude representation, because the former can more accurately incorporate the perceptual properties of human hearing. For purpose of comparison the present invention includes the performance scores of 2400 bps Federal Standard FS 1015 LPC-10e algorithm. The proposed system outperforms the LPC-10e and the STC-C for all test samples.

TABLE 2

BSD/BSDR data for the 2.4 Kbps sine wave transform vocoder

| | coding method | | |
|---|---|---|---|
| speech testing | STC-B | STC-C | LPC-10e |
| male-1 | 0.017/14.02 | 0.032/12.43 | 0.147/7.2 |
| male-2 | 0.024/13.14 | 0.049/11.48 | 0.110/7.93 |
| female-1 | 0.028/12.62 | 0.045/11.42 | 0.152/7.09 |
| female-2 | 0.026/12.96 | 0.042/11.45 | 0.116/8.04 |
| average | 0.023/13.19 | 0.042/11.70 | 0.131/7.57 |

While the preferred embodiment of the invention has been illustrated and described, it will be appreciated that various changes can be made therein without departing from the spirit and scope of the invention.

What is claimed is:

1. A coding method based on Bark spectrum said coding method comprising:

modeling amplitudes of a speech spectrum by using a harmonic wave modeling to obtain a speech waveform;

transferring said speech waveform from a frequency spectrum to a Bark spectrum to obtain Bark parameters using a Bark-to-Hz transformation;

integrating said Bark parameters to obtain a frequency response of an excitation pattern using a critical-band integration;

transferring said frequency response to a loudness by using an equal-loudness pre-emphasis;

transferring said loudness to a subjective loudness;

quantizing said subjective loudness to obtain quantized subjective loudness using a pulse coding modulation (PCM);

transferring said quantized subjective loudness to said subjective loudness using an inverse pulse coding modulation;

transferring said subjective loudness to said loudness;

transferring said loudness to obtain said excitation pattern using an equal de-emphasis;

transferring said Bark spectrum to said frequency spectrum;

achieving a harmonic wave frequency and amplitude by using pitch and voicing probability, wherein an input energy ($|X(f)|^2$) of said coding method is equal to $|X(Y(b))|^2$, whereas an output D(b) of critical band filters is equal to $F(b)*|X(Y(b))|^2$, wherein said Y(b) is referred to a relationship from the Bark b to the frequency f, wherein said F(b) is referred to filters, and $$Y(b)=f=600\ \sinh[(b+0.5)/6]\text{Hz}$$

$$b=Y^{-1}(f)=6\ \ln\{(f/600)+[(f/600)^2+1]^{1/2}\}-0.5\ \text{Bark};$$

wherein said output D(b) of said critical band filters presented in a matrix form is:

$$\begin{bmatrix} f_{1,0} & f_{1,1} & \cdots & f_{1,N/2-1} \\ f_{2,0} & f_{2,1} & \cdots & f_{2,N/2-1} \\ \vdots & \vdots & \ddots & \vdots \\ f_{B,0} & f_{B,1} & \cdots & f_{B,N/2-1} \end{bmatrix} \begin{bmatrix} \vdots \\ X_1 \\ \vdots \\ X_p \\ \vdots \end{bmatrix} = \begin{bmatrix} D(1) \\ D(2) \\ \vdots \\ D(B) \end{bmatrix}$$

wherein said $f_{i,j}=F(Y^{-1}(j*f_s/N)-i)$, wherein said $f_s$ is the sampling frequency, wherein said N is the length of FFT, wherein said B is the number of said critical band filters;

assuming there is no overlap between said critical band filters, wherein said output D(b) of said critical band filters presented in a matrix form is:

$$\begin{bmatrix} f_{1,0} \cdots f_{1,b_1} & 0 & \cdots & 0 \\ & & & \vdots \\ 0 \cdots 0 & f_{2,b+1} \cdots f_{2,b_2} & & 0 \\ \vdots & & \ddots & \\ 0 & \cdots & 0 & f_{B,b_{B-1}+1} \cdots f_{B,b_B} \end{bmatrix} \begin{bmatrix} \vdots \\ X_1 \\ \vdots \\ X_p \\ \vdots \end{bmatrix} = \begin{bmatrix} D(1) \\ D(2) \\ \vdots \\ D(B) \end{bmatrix}$$

wherein said $b_i=Y(i+0.5)*N/f_s$.

2. A coding method of claim 1, wherein said output D(b) of said critical band filters is $$D(i)=f_{i,j_1}X_{i1}+f_{i,j_2}X_{i2}+\ldots+f_{i,j_m}X_{im}+\ldots+f_{i,j_M}X_{iM}\quad 1\leqq i\leqq B$$

wherein said $f_{i,jm}$ is the filter coefficient of the m-th harmonic wave $X_{im}$ in accordance with the i-th critical band filter, wherein said M is the harmonic wave number in i-th critical band filter.

3. A coding method of claim 1, the energy of each said harmonic wave in the same said critical band filter is equal, wherein said excitation pattern D(b) of said critical band filters is:

$$D(i) = f_{i,j_1} X_{i1} + f_{i,j_2} X_{i2} + \ldots + f_{i,j_M} X_{iM}$$

$$= (f_{i,j_1} + f_{i,j_2} + \ldots + f_{i,j_M}) \cdot \overline{X} = f_i \cdot \overline{X},\ 1 \le i \le B.$$

.

4. A coding method of claim 1, wherein said pulse coding modulation is 39 bits.

5. A synthesis method based on a Bark spectrum, said synthesis method comprising:

transferring channel gains to a subjective loudness using an inverse pulse code modulation;

transferring said subjective loudness to a loudness;

transferring said loudness to obtain an excitation pattern using an equal de-emphasis;

transferring said Bark spectrum to a frequency spectrum;

achieving harmonic wave frequencies and amplitudes by using pitch and voicing probability;

wherein said excitation pattern D(b) is equal to output of critical band filters $F(b)*|X(Y(b))|^2$, wherein said Y(b) is referred to a relationship from the Bark b to the frequency f, wherein said F(b) is referred to said critical band filters, and $$Y(b)=f=600\ \sinh[(b+0.5)/6]\text{Hz}$$

$$b=Y^{-1}(f)=6\ \ln\{(f/600)+[(f/600)^2+1]^{1/2}\}-0.5\ \text{Bark};$$

wherein said excitation pattern D(b) presented in a matrix form is:

$$\begin{bmatrix} f_{1,0} & f_{1,1} & \cdots & f_{1,N/2-1} \\ f_{2,0} & f_{2,1} & \cdots & f_{2,N/2-1} \\ \vdots & \vdots & \ddots & \vdots \\ f_{B,0} & f_{B,1} & \cdots & f_{B,N/2-1} \end{bmatrix} \begin{bmatrix} \vdots \\ X_1 \\ \vdots \\ X_p \\ \vdots \end{bmatrix} = \begin{bmatrix} D(1) \\ D(2) \\ \vdots \\ D(B) \end{bmatrix}$$

wherein said $f_{i,j}=F(Y^{-1}(j*f_s/N)-i)$, wherein said $f_s$ is the sampling frequency, wherein said N is the length of FFT, wherein said B is the number of said critical band filters;

assuming there is no overlap between said critical band filters, wherein said excitation pattern D(b) presented in a matrix form is:

$$\begin{bmatrix} f_{1,0} \cdots f_{1,b_1} & 0 & \cdots & 0 \\ & & & \vdots \\ 0 \cdots 0 & f_{2,b+1} \cdots f_{2,b_2} & & 0 \\ \vdots & & \ddots & \\ 0 & \cdots & 0 & f_{B,b_{B-1}+1} \cdots f_{B,b_B} \end{bmatrix} \begin{bmatrix} \vdots \\ X_1 \\ \vdots \\ X_p \\ \vdots \end{bmatrix} = \begin{bmatrix} D(1) \\ D(2) \\ \vdots \\ D(B) \end{bmatrix}$$

wherein said $b_iY(i+0.5)*N/f_s$.

6. A synthesis method of claim 5, wherein said excitation pattern D(b) is $$D(i)=f_{i,j_1}X_{i1}+f_{i,j_2}X_{i2}+\ldots+f_{i,j_m}X_{im}+\ldots+f_{i,j_M}X_{iM}\quad 1\leqq i\leqq B$$

wherein said $f_{i,jm}$ is the filter coefficient of the m-th harmonic wave $X_{im}$ in accordance with the i-th critical band filter, wherein said M is the harmonic wave unmber in i-th critical band filter.

7. A synthesis method of claim 5, the energy of each said harmonic wave in the same said critical band filter is equal, wherein said excitation pattern D(b) is:

$$D(i) = f_{i,j_1} X_{i1} + f_{i,j_2} X_{i2} + \ldots + f_{i,j_M} X_{iM}$$

$$= (f_{i,j_1} + f_{i,j_2} + \ldots + f_{i,j_M}) \cdot \overline{X} = f_i \cdot \overline{X},\ 1 \le i \le B.$$

.

8. A synthesis method of claim 5, wherein said pulse coding modulation is 39 bits.

* * * * *